US007044852B2

(12) United States Patent
Horton

(10) Patent No.: US 7,044,852 B2
(45) Date of Patent: May 16, 2006

(54) OFF-RIDGE ROOF VENT

(75) Inventor: Jim W. Horton, Jacksonville, FL (US)

(73) Assignee: Gibraltar Steel Corporation, Buffalo, NY (US)

( * ) Notice: Subject to any disclaimer, the term of this patent is extended or adjusted under 35 U.S.C. 154(b) by 91 days.

(21) Appl. No.: 10/806,002

(22) Filed: Mar. 22, 2004

(65) Prior Publication Data

US 2005/0233691 A1 Oct. 20, 2005

(51) Int. Cl.
*F24F 7/02* (2006.01)

(52) U.S. Cl. ..... 454/365; 454/366; 52/198

(58) Field of Classification Search ..... 454/364, 454/365, 366; 52/198, 199
See application file for complete search history.

(56) References Cited

U.S. PATENT DOCUMENTS 5,288,269 A * 2/1994 Hansen ..... 454/365
5,772,502 A * 6/1998 Smith ..... 454/365
5,797,222 A * 8/1998 Martin ..... 52/198
5,924,925 A * 7/1999 Nystrom ..... 454/365
6,149,517 A * 11/2000 Hansen ..... 454/365
6,371,847 B1 * 4/2002 Headrick ..... 454/365

* cited by examiner

*Primary Examiner*—Derek S. Boles
(74) *Attorney, Agent, or Firm*—Arthur G. Yeager

(57) ABSTRACT

An off-ridge roof vent includes a hood open along the sides and front and a rear flange for mounting the hood to a roof. A pair of side walls each includes lower flanges to mount to a flat roof and upper bent tabs that fit under the hood to provide a tight fit between the walls and hood. A front baffle wall extends upwardly from a flange and opening and extends under the hood and terminates in a channel to mount one edge of a screen and another channel is formed in a subtending wall from the hood to mount the other edge of the screen to prevent the entry of debris into the vented roof space. All of the flanges are connected and are in the same plane so that the vent may be attached to a flat roof.

20 Claims, 3 Drawing Sheets

OFF-RIDGE ROOF VENT

CROSS-REFERENCE TO RELATED APPLICATION

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to vents to be installed in building roofs and particularly to off-ridge roof vents employing apparatus to minimize the entrance of moisture and debris into the vented space.

2. Relevant Art

A wide variety of roof vents exist that are comprised of a complex set of elements that are not easily assembled or installed. In addition, baffles are needed to control airflow and prevent entrance into the vented space of water and debris.

BRIEF SUMMARY OF THE INVENTION

A roof vent adapted to be mounted to a roof comprising a hood member having a front portion defining a front opening and a rear portion mountable over an opening in a roof, a pair of spaced side wall members extending between the front and rear portions of the hood member, and a baffle wall spaced forwardly of the front portion of the hood member and extending substantially the width of the front opening to inhibit entry of wind into the front opening. The front portion of the hood member includes an elongate subtending front wall member. The front wall includes a lower elongate edge portion formed into a first channel open rearwardly extending substantially the complete width of the front wall. The baffle wall includes an upper edge portion and a lower edge portion. The upper edge portion of the baffle wall formed as a lip for diverting wind directed against the baffle wall upwardly to minimize the amount of such wind entering the front opening.

Also included is an elongate horizontal member extending the width of the baffle wall having a front edge portion integral with the lower edge portion of the baffle wall and a rear portion having a vertical disposed wall member. The wall member of the rear portion of the member includes an upper edge portion formed as a second channel open forwardly extending substantially the width of the horizontal member. A filter means is mounted between the first and second channels and includes a screen member. Each side wall member includes a lower edge portion and an upper edge portion, the lower edge portion including a first bendable planar flange member being movable 90° to locate the flange member against a surface of a roof. The upper edge portion of each side wall includes at least one second bendable planar flange member being movable 90° to locate the second flange member inside the hood member.

A roof vent adapted to be mounted to a roof vent adapted to be mounted to a roof comprising a hood member having front and rear portions and a pair of parallel spaced edge portions integral with the rear portion for mounting the hood member over an opening in a roof. The front portion is spaced away from a surface of a roof when the hood member is mounted to a roof to define a pair of spaced side openings and a front opening, a pair of side wall members for covering a respective side opening, and a baffle wall spaced forwardly of the front portion of the hood member, the baffle wall extending substantially the width of the front opening to inhibit entry of wind into the front opening. The front portion of the hood member includes a subtending front wall member extending between the edge portions. The front wall includes a lower elongate edge portion formed into a first channel open rearward extending substantially the complete width of the front wall. The baffle wall includes an upper edge portion formed as a lip for diverting wind directed against the baffle wall upwardly to minimize the amount of such wind entering the front opening. An elongate horizontal member extends the width of the baffle wall having a front edge portion integral with the lower edge portion of the baffle wall and a rear portion having a vertical disposed wall member, the wall member of the rear portion of the member including an upper edge portion formed as a second channel open forward extending substantially the width of the horizontal member. Filter means is mounted between the first and second channels and includes a screen member. Each side wall member includes a lower edge portion and an upper edge portion, the lower edge portion including a first bendable planar flange member being movable 90° to locate the flange member against a surface of a roof. The upper edge portion of each side wall includes at least one second bendable planar flange member being movable 90° to locate the second flange member inside the hood member.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 3:
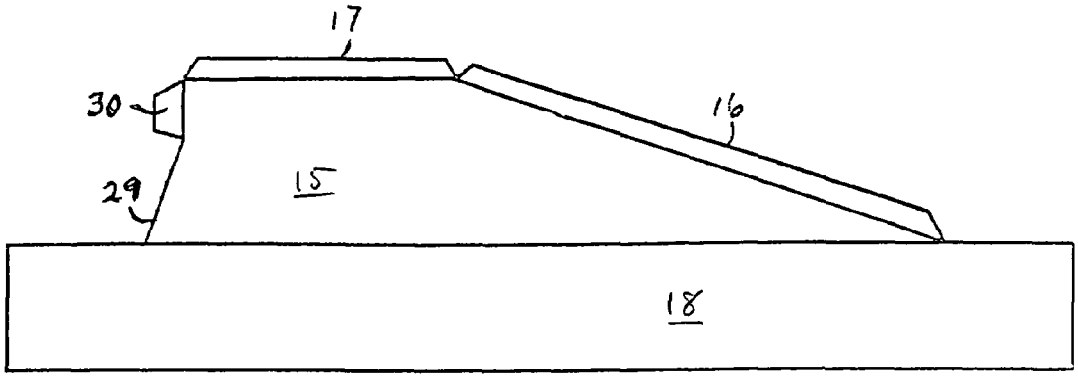
FIG. 3 is a plan view of one end cap of the vent of FIG. 1.
Figure 4:
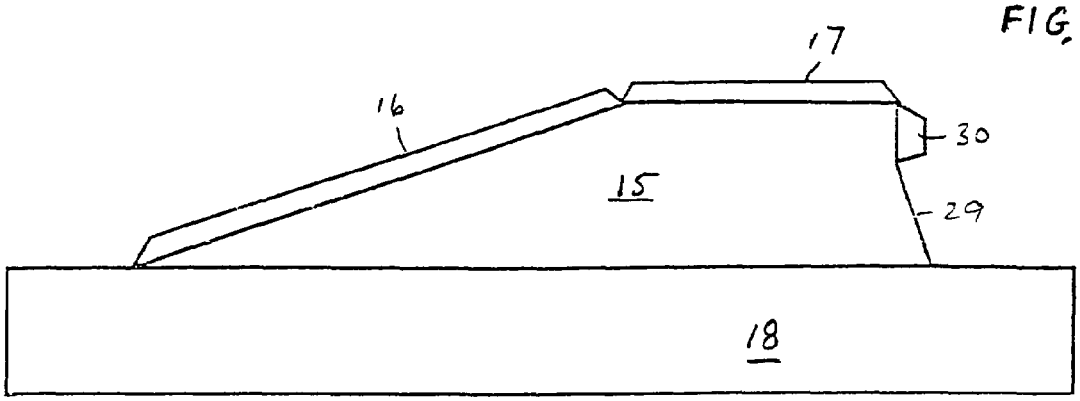
FIG. 4 is a view of another end cap of the vent of FIG. 1.

Referring now to the drawings, the off-ridge roof vent in accord with the present invention is shown at numeral 10. A hood member 11 includes a flat horizontal portion 12 and a rear downwardly sloped portion 13 terminating in flange 14. Two substantially identical side end cap members 15 (FIGS. 3 and 4) each include an inwardly bendable edge portion 16 adjacent portion 13 and another inwardly bendable edge portion 17 adjacent portion 12. A lower outwardly bendable flange 18 is used to mount the vent 10 to a roof.

Figure 1:
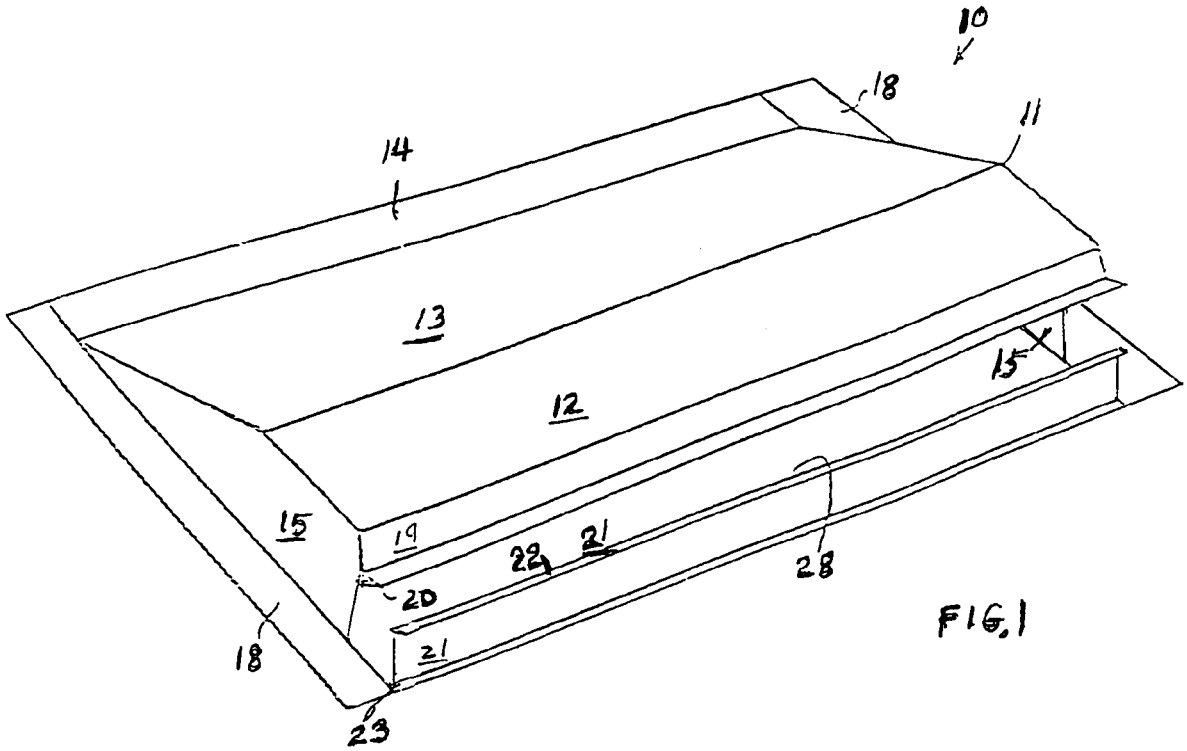
FIG. 1 is a perspective view of the off-ridge roof vent in accord with the present invention.
Figure 2:
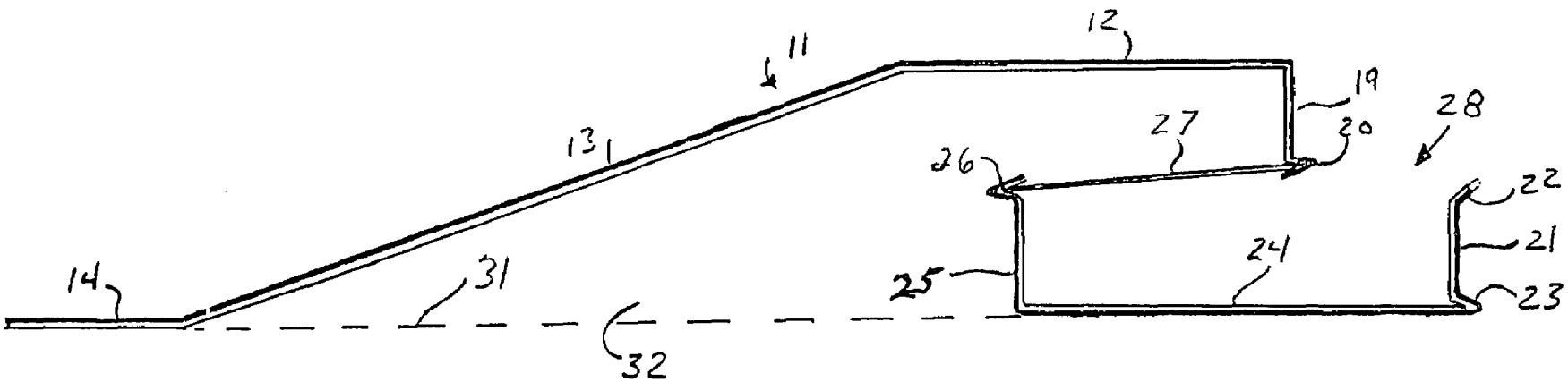
FIG. 2 is a side elevational pictorial view of two of the components of the vent of FIG. 1.

Further detail of the construction of the vent 10 is illustrated in FIG. 2. A front vertical wall portion 19 extends downwardly from portion 12 and terminates in a channel 20 formed by crimping the lower edge of wall 19. A separate metal sheet is shaped to make baffle assembly including external wind baffle wall 21 bound by an upper angled lip 22 and a lower lip 23 formed by crimping the sheet to form flat floor member 24 and a further 90° bend to form a vertical rear wall 25 having an upper edge crimped to form a channel 26. Channels 20 and 26 are used to carry a planar screen 27. The space between channel 20 and upper lip 22 of baffle wall 21 defines an opening 28 into vent 10.

Preferably, the hood member of the vent 10 including portions 12, 13, 14, 19 and 20 are formed of a single sheet of metal. Similarly, baffle assembly portions 21, 22, 23, 24, 25 and 26 are also formed from a single sheet of metal. End caps 15 are also formed from a single sheet of metal and further include a forward edge portion 29 and a foldable tab 30 that with edge portions 16 and 17 is bent 90° to fit flush against the inner surfaces of respective portions 12, 13 and 19.

The various parts are secured together by appropriate fastening means such as S-lok connections that brad the pieces together without penetrating either piece and/or blind rivets securing overlapping tabs or flanges at appropriate locations and/or spot welding, as is common in the art.

The vent 10 consists of four main components: a hood member 11 shaped into a flat portion 12, a sloping portion 13, a rear flange 14 and front wall with a channel 20 for carrying one edge of screen 27; two end caps 15; and the baffle assembly providing wall 21 and one channel 26 for carrying one edge of a screen 27.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed is:

1. A roof vent adapted to be mounted to a flat surface of a roof comprising a hood member having a front portion defining a front opening and a rear portion mountable over an opening in a roof, a pair of spaced side wall members extending between said front and rear portions of said hood member, and a baffle wall spaced forwardly of said front portion of said hood member and extending substantially the width of said front opening to inhibit entry of wind into said front opening, said front portion of said hood member including an elongate subtending front wall member, said front wall member including a lower elongate edge portion extending substantially the complete width of said front wall member, said hood member including a rear flange, each side wall member having a lower flange, said flanges being coplanar and adapted to lie against and be affixed on a flat surface of a roof.

2. The roof vent as defined in claim 1 wherein said baffle wall includes an upper edge portion and a lower edge portion, said upper edge portion of said baffle wall formed as a lip for diverting wind directed against said baffle wall upwardly to minimize the amount of such wind entering said front opening.

3. A roof vent adapted to be mounted to a roof comprising a hood member having a front portion defining a front opening and a rear portion mountable over an opening in a roof, a pair of spaced side wall members extending between said front and rear portions of said hood member, and a baffle wall spaced forwardly of said front portion of said hood member and extending substantially the width of said front opening to inhibit entry of wind into said front opening, said front portion of said hood member including an elongate subtending front wall member, said front wall member including a lower elongate edge portion formed into a first channel open rearwardly extending substantially the complete width of said front wall, an elongate horizontal member extending the width of said baffle wall having a front edge portion integral with said lower edge portion of said baffle wall and a rear portion having a vertical disposed wall member, said vertically disposed wall member of said rear portion including an upper edge portion formed as a second channel open forwardly extending substantially the width of said horizontal member.

4. The roof vent as defined in claim 3 further including a filter means mounted between said first and second channels.

5. The roof vent as defined in claim 4 wherein said filter means includes a screen member.

6. A roof vent adapted to be mounted to a roof comprising a hood member having a front portion defining a front opening and a rear portion mountable over an opening in a roof, a pair of spaced side wall members extending between said front and rear portions of said hood member, and a baffle wall spaced forwardly of said front portion of said hood member and extending substantially the width of said front opening to inhibit entry of wind into said front opening, said front wall member including a lower elongate edge portion formed into a first channel extending substantially the complete width of said front wall, an elongate horizontal member extending the width of said baffle wall having a front edge portion integral with said lower edge portion of said baffle wall and a rear portion having a vertical disposed wall member, said wall member of said rear portion of said member including an upper edge portion formed as a second channel extending substantially the width of said horizontal member.

7. A roof vent adapted to be mounted to a flat surface of a roof comprising a hood member having front and rear portions and a pair of parallel spaced edge portions integral with said front and rear portions for locating said hood member over an opening in a roof, said front portion being spaced away from a surface of a roof when said hood member is mounted to a roof to define a pair of spaced side openings and a front opening, a pair of side wall members for covering a respective said side opening, and a baffle wall spaced forwardly of said front portion of said hood member, said baffle wall extending substantially the width of said front opening to inhibit entry of wind into said front opening, said hood member having at least three flanges extending laterally on respective opposite sides thereof and rearwardly, said three flanges being connected to each other and forming a plane adapted to be affixed on a flat surface of a roof.

8. The roof vent as defined in claim 7 wherein said front portion of said hood member includes a subtending front wall member extending between said edge portions.

9. The roof vent as defined in claim 8 wherein said front wall includes a lower elongate edge portion extending substantially the complete width of said front wall.

10. The roof vent as defined in claim 7 wherein said baffle wall includes an upper edge portion and a lower edge portion, said upper edge portion of said baffle wall formed as a lip for diverting wind directed against said baffle wall upwardly to minimize the amount of such wind entering said front opening.

11. A roof vent adapted to be mounted to a roof comprising a hood member having front and rear portions and a pair of parallel spaced edge portions integral with said front and rear portions for locating said hood member over an opening in a roof, said front portion being spaced away from a surface of a roof when said hood member is mounted to a roof to define a pair of spaced side openings and a front opening, a pair of side wall members for covering a respective said side opening and a baffle wall spaced forwardly of said front portion of said hood member, said baffle wall extending substantially the width of said front opening to inhibit entry of wind into said front opening, said front portion of said hood member includes a subtending front wall member extending between said edge portions, said front wall includes a lower elongate edge portion extending substantially the complete width of said front wall, an elongate horizontal member extending the width of said baffle wall having a front edge portion integral with said lower edge portion of said baffle wall and a rear portion having a vertical disposed wall member, said wall member of said rear portion of said member including an upper edge portion extending substantially the width of said horizontal member.

12. A roof vent adapted to be mounted to a roof comprising a hood member having front and rear portions and a pair of parallel spaced edge portions integral with said front and rear portions and a pair of parallel spaced edge portions integral with said front and rear portions for locating said hood member over an opening in a roof, said front portion being spaced away from a surface of a roof when said hood member is mounted to a roof to define a pair of spaced side openings and a front opening, a pair of side wall members for covering a respective said side opening, and a baffle wall spaced forwardly of said front portion of said hood member, said baffle wall extending substantially the width of said front opening to inhibit entry of wind into said front opening, said front portion of said hood member includes a subtending front wall member having a lower edge portion extending substantially the complete width of said front wall, an elongate horizontal member extending the width of said baffle wall having a front edge portion integral with said lower edge portion of said baffle wall and a rear portion having a vertical disposed wall member, said wall member of said rear portion of said member including an upper edge portion extending substantially the width of said horizontal member.

13. A roof vent adapted to be mounted to a flat surface of a roof comprising a hood member having front and rear portions and a pair of parallel spaced edge portions integral with said front and rear portions for disposing said hood member over an opening in a roof, said front portion being spaced away from a flat surface of a roof when said hood member is mounted to a roof to define a pair of spaced side openings and a front opening, a pair of side wall member for covering a respective said side opening, and a baffle wall spaced forwardly of said front portion of said hood member, said baffle wall extending substantially the width of said front opening to inhibit entry of wind into said front opening, said rear portion of said hood member including a rear flange having opposite end portions, each said side wall member including a lower flange having a front end portion and a rear end portion, said baffle wall including a lower flange having opposite end portions, each said rear end portion of said lower flange of each said side wall member being connected to a respective said end portion of said rear flange of said hood member and each said end portion of said lower flange of a corresponding said side wall member, said flanges being coplanar and adapted to be affixed on a flat surface of a roof.

14. The roof vent as defined in claim 13 wherein each said side wall member includes a plurality of spaced flanges, said spaced flanges being connected to a respective edge portion of said hood member.

15. The roof vent as defined in claim 1 further including an elongate horizontal member extending the width of said baffle wall having a front edge portion integral with said lower edge portion of said baffle wall and a rear portion having a vertical disposed wall member, said wall member of said rear portion of said member including an upper edge portion extending substantially the width of said horizontal member.

16. The roof vent as defined in claim 9 further including an elongate horizontal member extending the width of said baffle wall having a front edge portion integral with said lower edge portion of said baffle wall and a rear portion having a vertical disposed wall member, said wall member of said rear portion of said member including an upper edge portion extending substantially the width of said horizontal member.

17. The roof vent as defined in claim 11 further including a filter means mounted between said lower elongate edge portion and said upper edge portion.

18. The roof vent as defined in claim 7 further including an elongate horizontal member extending the width of said baffle wall having a front edge portion integral with said lower edge portion of said baffle wall and a rear portion having a vertical disposed wall member, said wall member of said rear portion of said member including an upper edge portion extending substantially the width of said horizontal member.

19. The roof vent as defined in claim 13 wherein said baffle wall includes an upper edge portion and a lower edge portion, said upper edge portion of said baffle wall formed as a lip for diverting wind directed against said baffle wall upwardly to minimize the amount of such wind entering said front opening.

20. The roof vent as defined in claim 13 wherein said front portion of said hood member includes an elongate front wall member, said front wall member including a lower elongate edge portion extending substantially the complete width of said front wall, an elongate horizontal member extending the width of said baffle wall having a front edge portion integral with said lower edge portion of said baffle wall and a rear portion having a vertical disposed wall member, said wall member of said rear portion including an upper edge portion extending substantially the width of said horizontal member, said baffle wall including an upper edge portion and a lower edge portion, said upper edge portion of said baffle wall formed as an outwardly turned lip for diverting wind directed against said baffle wall upwardly to minimize the amount of such wind entering said front opening.

* * * * *

US007044852C1

(12) EX PARTE REEXAMINATION CERTIFICATE (9691st)

United States Patent

Horton

(10) Number: US 7,044,852 C1

(45) Certificate Issued: Jun. 3, 2013

(54) OFF-RIDGE ROOF VENT

(75) Inventor: Jim W. Horton, Jacksonville, FL (US)

(73) Assignee: Southeastern Metals Manufacturing Company, Inc., Jacksonville, FL (US)

Reexamination Request:
No. 90/012,163, Feb. 27, 2012

Reexamination Certificate for:

| | |
|---|---|
| Patent No.: | **7,044,852** |
| Issued: | **May 16, 2006** |
| Appl. No.: | **10/806,002** |
| Filed: | **Mar. 22, 2004** |

(51) Int. Cl.
*F24F 7/02* (2006.01)

(52) U.S. Cl.
USPC ..... 454/365; 454/366; 52/198

(58) Field of Classification Search
None
See application file for complete search history.

(56) References Cited

To view the complete listing of prior art documents cited during the proceeding for Reexamination Control Number 90/012,163, please refer to the USPTO's public Patent Application Information Retrieval (PAIR) system under the Display References tab.

*Primary Examiner* — Russell Stormer

(57) ABSTRACT

An off-ridge roof vent includes a hood open along the sides and front and a rear flange for mounting the hood to a roof. A pair of side walls each includes lower flanges to mount to a flat roof and upper bent tabs that fit under the hood to provide a tight fit between the walls and hood. A front baffle wall extends upwardly from a flange and opening and extends under the hood and terminates in a channel to mount one edge of a screen and another channel is formed in a subtending wall from the hood to mount the other edge of the screen to prevent the entry of debris into the vented roof space. All of the flanges are connected and are in the same plane so that the vent may be attached to a flat roof.

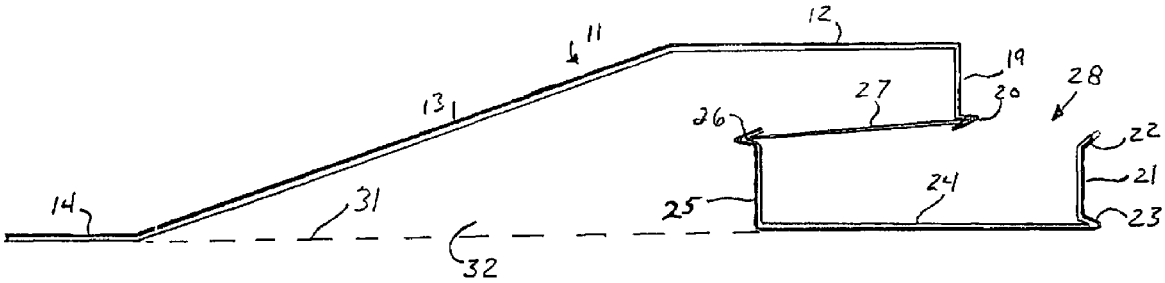

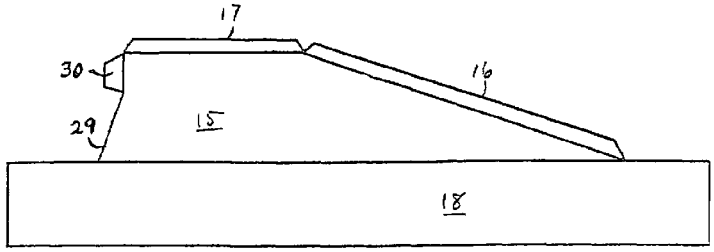

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3, 6, 7, 11, 12 and 13 are determined to be patentable as amended.

Claims 2, 4, 5, 8-10 and 14-20, dependent on an amended claim, are determined to be patentable.

New claims 21-26 are added and determined to be patentable.

1. [A] *An off-ridge* roof vent adapted to be mounted to a flat surface of a roof comprising a hood member having a front portion *with a flat horizontal portion and a front wall portion* defining a front opening and a rear portion mountable over an opening in a roof, *said front portion being spaced away from a surface of the roof when the hood member is mounted to the roof to define a pair of spaced side openings,* a pair of spaced side wall members extending between said front [and] *portion with a flat horizontal portion and a front wall portion, said* rear [portions] *portion* of said hood member *and the flat surface of the roof to entirely cover the spaced side openings,* and a baffle wall spaced forwardly of said front portion of said hood member [and extending], *wherein the baffle wall extends* substantially the width of said front opening to inhibit entry of wind into said front opening, *a rear wall and flat floor member between said baffle wall and said rear wall, wherein the top of the baffle wall is substantially the same height as the bottom of the front wall portion and the top of the rear wall and* said front portion of said hood member including an elongate subtending front wall member, said front wall member including a lower elongate edge portion extending substantially the complete width of said front wall [member] *portion*, said hood member including a rear flange, each side wall member having a lower flange, said flanges being coplanar and adapted to lie against and be affixed on a flat surface of a roof.

3. [A] *An off-ridge* roof vent adapted to be mounted to a roof comprising a hood member having a front portion defining a front opening and a rear portion mountable over an opening in a roof, *said front portion being spaced away from a surface of the roof when the hood member is mounted to the roof to define a pair of spaced side openings,* a pair of spaced side wall members extending between said front [and] *portion, said* rear [portions] *portion* of said hood member, *and the flat surface of the roof to entirely cover the spaced side openings* and a baffle wall spaced forwardly of said front portion of said hood member and extending substantially the width of said front opening to inhibit entry of wind into said front opening, said front portion of said hood member including an elongate subtending front wall member, said front wall member including a lower elongate edge portion formed into a first channel open rearwardly extending substantially the complete width of said front wall, an elongate horizontal member extending the width of said baffle wall having a front edge portion integral with said lower edge portion of said baffle wall and a rear portion having a vertical disposed wall member, said vertically disposed wall member of said rear portion including an upper edge portion formed as a second channel open forwardly extending substantially the width of said horizontal member, *wherein the top of the baffle wall is substantially the same height as the lower elongate edge portion of the front wall member and the top of the vertical disposed wall member.*

6. A roof vent adapted to be mounted to a roof comprising a hood member having a front portion defining a front opening and a rear portion mountable over an opening in a roof, *said front portion being spaced away from a surface of the roof when the hood member is mounted to the roof to define a pair of spaced side openings,* a pair of spaced side wall members extending between said front [and] *portion, said* rear [portions] *portion* of said hood member *and the flat surface of the roof to entirely cover the spaced side openings,* and a baffle wall spaced forwardly of said front portion of said hood member and extending substantially the width of said front opening to inhibit entry of wind into said front opening, said front wall member including a lower elongate edge portion formed into a first channel extending substantially the complete width of said front wall, an elongate horizontal member extending the width of said baffle wall having a front edge portion integral with said lower edge portion of said baffle wall and a rear portion having a vertical disposed wall member, said wall member of said rear portion of said member including an upper edge portion formed as a second channel extending substantially the width of said horizontal member *and wherein the top of the baffle wall is substantially the same height as the bottom of the front wall member and the top of the vertical disposed wall member.*

7. [A] *An off-ridge* roof vent adapted to be mounted to a flat surface of a roof comprising a hood member having *a* front *portion with a flat horizontal portion and a front wall portion* and *a* rear [portions] *portion* and a pair of parallel spaced edge portions integral with said front and rear portions fbr locating said hood member over an opening in a roof, said front portion being spaced away from a surface of a roof when said hood member is mounted to a roof to define a pair of spaced side openings and a front opening, a pair of side wall members for covering a respective said side opening, and a baffle wall spaced forwardly of said front portion of said hood member, said baffle wall extending substantially the width of said front opening to inhibit entry of wind into said front opening, said hood member having at least three flanges extending laterally on respective opposite sides thereof and rearwardly, said three flanges being connected to each other and forming a plane adapted to be affixed on a flat surface of a roof *and wherein the top of the baffle wall is substantially the same height as the bottom of the front wall portion.*

11. A roof vent adapted to be mounted to a roof comprising a hood member having front and rear portions and a pair of parallel spaced edge portions integral with said front and rear portions for locating said hood member over an opening in a roof, said front portion being spaced away from a surface of a roof when said hood member is mounted to a roof to define a pair of spaced side openings and a front opening, a pair of side wall members for covering a respective said side opening and a baffle wall spaced forwardly of said front portion of said hood member, said baffle wall extending substantially the width of said front opening to inhibit entry of wind into said front opening, said front portion of said hood member includes a subtending front wall member extending between said edge portions, said front wall includes a lower elongate edge portion extending substantially the complete width of said front wall, an elongate horizontal member extending the width of said baffle wall having a front edge portion integral with said lower edge portion of said baffle wall and a rear portion having a vertical disposed wall member, said wall member of said rear portion of said member including an upper edge portion extending substantially the width of said horizontal member *and wherein the top of the baffle wall is substantially the same height as the bottom of the front wall portion and the top of the vertical disposed wall member.*

12. A roof vent adapted to be mounted to a roof comprising a hood member having front and rear portions and a pair of parallel spaced edge portions integral with said front and rear portions and a pair of parallel spaced edge portions integral with said front and rear portions for locating said hood member over an opening in a roof, said front portion being spaced away from a surface of a roof when said hood member is mounted to a roof to define a pair of spaced side openings and a front opening, a pair of side wall members for covering a respective said side opening, and a baffle wall spaced forwardly of said front portion of said hood member, said baffle wall extending substantially the width of said front opening to inhibit entry of wind into said front opening, said front portion of said hood member includes a subtending front wall member having a lower edge portion extending substantially the complete width of said front wall, an elongate horizontal member extending the width of said baffle wall having a front edge portion integral with said lower edge portion of said baffle wall and a rear portion having a vertical disposed wall member, said wall member of said rear portion of said member including an upper edge portion extending substantially the width of said horizontal member *wherein the top of the baffle wall is substantially the same height as the bottom of the front portion and the top of the vertical disposed wall member.*

13. A roof vent adapted to be mounted to a flat surface of a roof comprising a hood member having front and rear portions and a pair of parallel spaced edge portions integral with said front and rear portions for disposing said hood member over an opening in a roof, said front portion being spaced away from a flat surface of a roof when said hood member is mounted to a roof to define a pair of spaced side openings and a front opening, a pair of side wall member for covering a respective said side opening, and a baffle wall spaced forwardly of said front portion of said hood member, said baffle wall extending substantially the width of said front opening to inhibit entry of wind into said front opening, said rear portion of said hood member including a rear flange having opposite end portions, each said side wall member including a lower flange having a front end portion and a rear end portion, said baffle wall including a lower flange having opposite end portions, each said rear end portion of said lower flange of each said side wall member being connected to a respective said end portion of said rear flange of said hood member and each said end portion of said lower flange of a corresponding said side wall member, said flanges being coplanar and adapted to be affixed on a flat surface of a roof *wherein the top of the baffle wall is substantially the same height as the bottom of the front portion.*

*21. An off-ridge roof vent adapted to be mounted to a flat surface of a roof comprising:*

*a hood member having a front portion with a flat horizontal portion and a front wall portion, a rear portion and a pair of parallel spaced edge portions integral with the front portion and the rear portion for locating the hood member over an opening in a roof, wherein the front portion is spaced away from a surface of a roof when the hood member is mounted to a roof to define a pair of spaced side opening and a front opening, a pair of side wall members for covering a respective said side opening, and a baffle wall spaced forwardly of the front portion of the hood member, a vertical rear wall and a flat floor member between the baffle wall and the rear wall, said rear wall including an upper edge portion extending substantially the width of said flat floor member wherein said vertical rear wall terminates at said upper edge portion, wherein the baffle wall, rear wall and flat floor member are formed of a single sheet of metal and the baffle wall is extending substantially the width of the front opening to inhibit entry of wind into the front opening, the hood member having at least three flanges extending laterally on respective opposite sides thereof and rearwardly, the three flanges being connected to each other and forming a plane adapted to be affixed on a flat surface of a roof.*

*22. An off-ridge roof vent adapted to be mounted to a flat surface of a roof comprising:*

*a hood member having a front portion with a flat horizontal portion and a front wall portion, a rear portion and a pair of parallel spaced edge portions integral with the front portion and the rear portion for locating the hood member over an opening in a roof, wherein the front portion is spaced away from a surface of a roof when the hood member is mounted to a roof to define a pair of spaced side openings and a front opening, a pair of side wall members for covering a respective said side opening, and a baffle wall spaced forwardly of the front portion of the hood member, a rear wall and a flat floor member between the baffle wall and the rear wall, wherein the baffle wall, rear wall and flat floor member are formed of a single sheet of metal and the baffle wall is extending substantially the width of the front opening to inhibit entry of wind into the front opening, the hood member having at least three flanges extending laterally on respective opposite sides thereof and rearwardly, the three flanges being connected to each other and forming a plane adapted to be affixed on a flat surface of a roof, wherein the top of the baffle wall is at substantially the same height as the bottom of the front wall portion.*

*23. An off-ridge roof vent adapted to be mounted to a flat surface of a roof comprising:*

*a hood member having a front portion with a flat horizontal portion and a front wall portion, a rear portion and a pair of parallel spaced edge portions integral with the front portion and the rear portion for locating the hood member over an opening in a roof, wherein the front portion is spaced away from a surface of a roof when the hood member is mounted to a roof to define a pair of spaced side openings and a front opening, a pair of side wall members for covering a respective said side opening, and a baffle wall spaced forwardly of the front portion of the hood member, a rear wall and a flat floor member between the baffle wall and the rear wall, wherein the baffle wall, rear wall and flat floor member are formed of a single sheet of metal, wherein the top of the baffle wall is substantially the same height as the bottom of the front wall portion and the top of the rear wall and the baffle wall is extending substantially the width of the front opening to inhibit entry of wind into the front opening, the baffle wall having an upper angled lip and a lower lip, the hood member having at least three flanges extending laterally on respective opposite sides thereof and rearwardly, the three flanges being connected to each other and forming a plane adapted to be affixed on a flat surface of a roof.*

*24. An off-ridge roof vent adapted to be mounted to a flat surface of a roof comprising*

*a hood member having a front portion defining a front opening and a rear portion mountable over an opening in a roof, said front portion being spaced away from a surface of the roof when the hood member is mounted to the roof to define a pair of spaced side openings, a pair of spaced side wall members extending between said front portion, said rear portion of said hood member and the flat surface of the roof to entirely cover the spaced side openings, and a baffle wall having an upper angled lip and a lower angled lip and spaced forwardly of said front portion of said hood member and extending substantially the width of said front opening to inhibit entry of wind into said front opening, a rear wall and flat floor member between said baffle wall and said rear wall, wherein said rear wall, flat floor member and baffle wall are formed of a single sheet of metal, said front portion of said hood member including an elongate subtending front wall member, said hood member including a rear flange, each side wall member having a lower flange, said flanges being coplanar and adapted to lie against and be affixed on a flat surface of a roof.*

*25. An off-ridge roof adapted to be mounted to a flat surface of a roof comprising*

*a hood member having a front portion defining a front opening and a rear portion mountable over an opening in a roof, said front portion being spaced away from a surface of the roof when the hood member is mounted to the roof to define a pair of spaced side openings, a pair of spaced side wall members extending between said front portion, said rear portion of said hood member and the flat surface of the roof to entirely cover the spaced side openings, and a baffle wall spaced forwardly of said front portion of said hood member and extending substantially the width of said front opening to inhibit entry of wind into said front opening, a rear wall and flat floor member between said baffle wall and said rear wall, wherein said rear wall, flat floor member and baffle wall are formed of a single sheet of metal, said front portion of said hood member including an elongate subtending front wall member, said front wall member including a lower elongate edge portion extending substantially the complete width of said front wall member, said hood member including a rear flange, each side wall member having a lower flange, said flanges being coplanar and adapted to lie against and be affixed on a flat surface of a roof.*

*26. An off-ridge roof vent adapted to be mounted to a flat surface of a roof comprising*

*a hood member having a front portion defining a front opening and a rear portion mountable over an opening in a roof, said front portion being spaced away from a surface of the roof when the hood member is mounted to the roof to define a pair of spaced side openings, a pair of spaced side wall members extending between said front portion, said rear portion of said hood member and the flat surface of the roof to entirely cover the spaced side openings, and a baffle wall having an upper angled lip and a lower lip and spaced forwardly of said front portion of said hood member and extending substantially the width of said front opening to inhibit entry of wind into said front opening, a rear wall and flat floor member between said baffle wall and said rear wall, wherein said rear wall, flat floor member and baffle wall are formed of a single sheet of metal, said front portion of said hood member including an elongate subtending front wall member, said front wall member including a lower elongate edge portion extending substantially the complete width of said front wall member, said hood member including a rear flange, each side wall member having a lower flange, said flanges being coplanar and adapted to lie against and be affixed on a flat surface of a roof.*

* * * * *